US005351944A

United States Patent [19]

Johnson

[11] Patent Number: 5,351,944

[45] Date of Patent: Oct. 4, 1994

[54] MANUFACTURER'S THIRD HAND VICE

[76] Inventor: John Johnson, Rt. 8, Box 116, DeRidder, La. 70634

[21] Appl. No.: 182,565

[22] Filed: Jan. 18, 1994

[51] Int. Cl.[5] ..... B25B 1/00

[52] U.S. Cl. ..... 269/254 CS; 269/257

[58] Field of Search ..... 254/254 CS, 254 R, 158, 254/159, 62, 257

[56] References Cited

U.S. PATENT DOCUMENTS

| | | | |
|---|---|---|---|
| 1,587,181 | 6/1926 | Pomeroy et al. | 269/158 |
| 2,712,769 | 7/1955 | Prescott | 269/254 CS |
| 4,123,047 | 10/1978 | Koht et al. | 269/254 R |
| 4,848,760 | 7/1989 | Blankenship et al. | 269/254 CS |

*Primary Examiner*—Robert C. Watson
*Attorney, Agent, or Firm*—Rod Bryant Jordan

[57] ABSTRACT

An apparatus for clamping and holding objects, on which work is to be performed, that can be operated by downward pressure of the workman's foot. The apparatus consists essentially of two jaws in a horizontally adjacent position. The lower jaw is rigidly fixed. The upper jaw is pulled down against the lower jaw by a vertical bar that is affixed to the upper jaw. The downward force is supplied by two springs. The spring force may be overcome by exerting foot pressure downward against a lever which is pivotally affixed to the vertical bar and is pined at its mid section to a rigid bracket.

2 Claims, 1 Drawing Sheet

MANUFACTURER'S THIRD HAND VICE

The invention as described herein comprises essentially an apparatus for use in clamping and holding items which are to be worked on. Most tools that are available for use in manufacturing, as well as maintenance work, are designed for two handed or at least partial two handed use. In cases where one handed tools are used the craftsman or technician usually opts to occupy his other hand in some sort of supportive role regarding the work being done. Human beings, being blessed with only two hands, are often faced with the need for an apparatus with which to hold the stock being prepared in place. Many devices, such as the simple screw vice, have been devised to address this need. Most of these devices require that one of the worker's hands be used to adjust or tighten the device while the other hand is needed to hold the stock in the proper position inside the jaws of the vice. This requires that the tools being used by the worker be put aside so that the adjustment may be made. The answer to this dilemma is to make use of the worker's foot in loading and unloading the stock.

Some devices, such as the device described in the patent "Foot Vice" by E. B. Newnam, Ser. No. #556,443, have been devised to make use of the foot for opening and closing, however, they lack the strength for heavier work, and they require constant foot pressure. The invention, as described herein, provides an apparatus that will hold in place a variety of sizes of stock, provides adequate strength and stability, and requires no attention except when stock is being loaded into its jaws.

SUMMARY OF THE INVENTION

The present invention relates to an apparatus, for holding work pieces of various shapes and sizes, which can be opened by downward pressure of the workman's foot. It comprises essentially a pair of jaws suitable for clamping various work pieces, a stand which supports the jaws at the proper height, a set of springs which hold tension upon the jaws in order to clamp the work piece in place, and a pedal and linkage assembly to overcome the pressure of the springs and open the jaws so that the work piece may be removed or adjusted.

BRIEF DESCRIPTION OF THE DRAWINGS

Figure one is a side elevation view of the third hand vice.

Figure two is a top elevation view of the base of the third hand vice.

Figure 1:
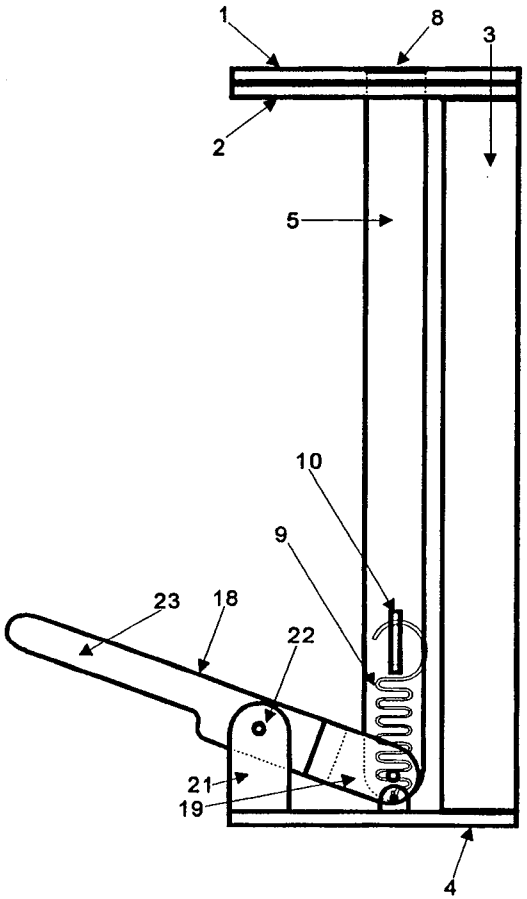
Figure 8:
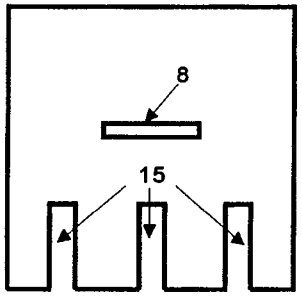
Figure 7:
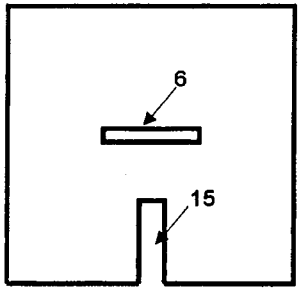
Figure 2:
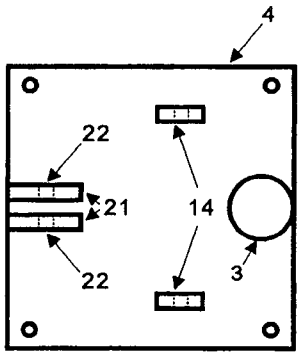
Figure 9:
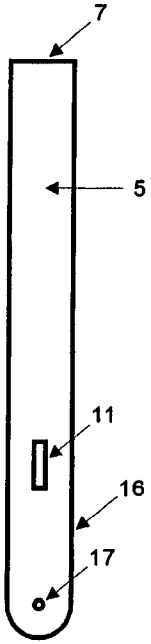
Figure 3:
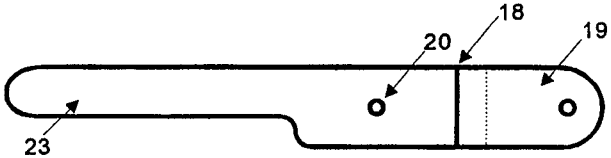
Figure 4:
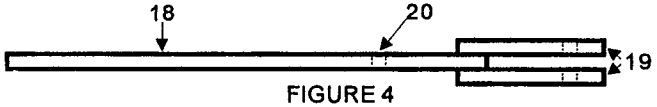
Figure 6:
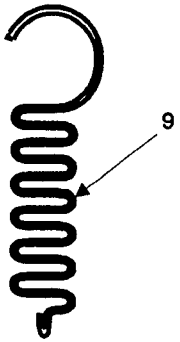
Figure 5:
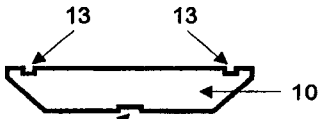

Figure three is a side elevation view of the foot pedal and lever.

Figure four is a top elevation view of the foot pedal and lever.

Figure five is a front elevation view of the spring tension equalizer bar.

Figure six is a side elevation view of one of the tension springs.

Figure seven is a top elevation view of the lower jaw.

Figure eight is a top elevation view of the upper jaw.

Figure nine is a side elevation view of the control bar.

DETAILED DESCRIPTION

Referring to the drawings it can be seen that a set of vice jaws consisting of an upper jaw 1 and a lower jaw 2 are positioned horizontally atop a supporting structure 3 which is in turned mounted vertically to and above a base 4. The lower jaw 2 is mounted rigidly atop the support structure 3. The upper jaw 1 is mounted adjustably atop the lower jaw 2. A control bar 5 is positioned vertically just forward of supporting structure 3. The lower jaw 2 is traversed by the control bar 5 through opening 6. The upper end 7 of the control bar 5 is welded or otherwise rigidly fastened to upper jaw 1 at mounting point 8. A tension spring 9 is positioned on both sides of control bar 5. A spring tension equalizer bar 10 traverses control bar 5 through opening 11. A centering notch 12 is located at a central point on the lower edge of the spring tension equalizer bar 10. This centering notch is positioned over the control bar insuring a central position. Springs 9 are stretched tightly from spring notches 13 on spring tension equalizer bar 10 to brackets 14 on base 4. This puts downward pressure on upper jaw 1, allowing stock to be clamped between upper jaw 1 and lower jaw 2. Cutouts 15 in upper jaw 1 and lower jaw 2 allow for more precise clamping of stock. The lower end 16 of control bar 5 is equipped with a control bar eyelet 17. A pedal and lever member 18 is also equipped with an eyelet in each of two forks 19 located at its forward end and a pivot eyelet 20 at its mid section. Base 4 is equipped with two pedal pivot brackets 21 at its forward edge. Pedal and lever member 18 is pivotally mounted to pedal pivot brackets 21 by inserting a pin through pivot bracket eyelets 22 on pedal pivot brackets 21 and pivot eyelet 20 at the mid section of pedal and lever member 18. The forward end of the pedal and lever member 18 is pivotally affixed to the lower end of control bar 5 by the insertion of a pin through the eyelets located on the two forks 19 at the forward end of pedal and lever member 18 and control bar eyelet 17 at lower end 16 of control bar 5. By using one's foot to put downward pressure on the pedal end 23 of pedal and lever member 18, the workman forces control bar 5 upward, overcoming the downward force of springs 9, and thereby raises upper jaw 1, opening the vice. After the work piece has been inserted, removed, or adjusted, foot pressure is released thus clamping the work piece into place by the downward force of springs 9.

The apparatus as described above provides for a new and innovative clamping device which will prove advantageous in many areas of today's work place.

I claim:

1. A free standing foot operated mechanism for clamping and holding objects in a fixed position comprising;

a. means for clamping and supporting said objects, said means further comprising an upper jaw, a lower jaw, a support structure, a control bar, a base, two tension springs, and a tension spring equalizer bar, said upper jaw comprising a horizontally positioned rectangular plate having a front, rear, and mid section and an upper and lower side, said lower Jaw comprising a horizontally positioned rectangular plate having a front, mid, and rear section and an upper and lower side, said upper jaw being positioned atop and aligned with said lower jaw, said base comprising a rectangular plate having a front, rear, and mid section, said base positioned a suitable distance below said jaws, said support structure comprising a vertically positioned, rigid member having a bottom end and a top end, said bottom end being affixed to said rear section of said base, said top end being rigidly affixed to said rear section of said underside of said lower jaw, said control bar comprising a rigid, vertically positioned member having an upper, mid, and lower end, said lower end further comprising an eyelet, said lower end being positioned just above said mid section of said base, said control bar also comprising a hole in said mid section, said tension spring equalizer bar traversing said control bar through said hole, said mid section of said lower jaw further comprising a hole, said upper end of said control bar traversing said hole in said mid section of said lower jaw and being rigidly affixed to said mid section of said underside of said upper jaw, said spring equalizer bar further comprising two ends, and a spring retaining notch at each of said ends, said base further comprising two spring retaining eyelet tabs said eyelet tabs being located below said spring retaining notches, said springs being affixed between said eyelet tabs and said spring retaining notches so as to exert downward pressure upon said control bar and thus said upper jaw, so as to exert pressure between said upper jaw and said lower jaw, thereby retaining said objects placed between said jaws; and b. means of releasing said objects by use of said foot comprising a pedal and lever member, two pedal pivot brackets each having a bracket eyelet, and two pivot pins, said pedal and lever member further comprising a bar having a rear, mid, and front end, said front end being equipped with extension plates, thus forming a fork, said plates each having a fork eyelet, said mid section having a pedal member pivot bracket eyelet, said lower end of said control bar being inserted into said fork, one of said pivot pins traversing said fork eyelets and said control bar eyelet thus pivotally affixing said lower end of said control bar to said front end of said pedal and lever member, said pedal pivot brackets being vertically affixed to said front section of said base so as to accommodate the insertion of said mid section of said pedal and lever member between said pedal pivot brackets, one of said pedal pivot pins traversing said bracket eyelets in said pedal pivot brackets and said pedal member pivot bracket eyelet so as to pivotally affix said mid section of said pedal and lever member to said pedal pivot brackets, said mid section of said pedal and lever member being elevated above said lower end of said control bar so as to elevate said rear end of said pedal and lever member thus allowing upward pressure to be applied to said control bar as said foot is pressed downward upon said rear end of said pedal and lever member, thus forcing said upper jaw upward and releasing said objects as the downward force of said springs is overcome by said upward pressure.

2. An apparatus as described in claim 1, wherein said upper and lower jaws further comprise a plurality of variously shaped cutouts, said cutouts providing a notched area between said jaws thereby further restraining said objects.

* * * * *